US007611255B1

(12) United States Patent
Lagassey

(10) Patent No.: US 7,611,255 B1
(45) Date of Patent: Nov. 3, 2009

(54) ILLUMINATION DEVICE MOUNTABLE THROUGH AN APERTURE IN A CLOTHING OBJECT

(75) Inventor: Paul J. Lagassey, Vero Beach, FL (US)

(73) Assignee: Kool Light, LLC, Vero Beach, FL (US)

( * ) Notice: Subject to any disclaimer, the term of this patent is extended or adjusted under 35 U.S.C. 154(b) by 263 days.

(21) Appl. No.: 11/845,091

(22) Filed: Aug. 27, 2007

(51) Int. Cl.
*F21V 21/08* (2006.01)

(52) U.S. Cl. ..... 362/103; 362/105; 362/106; 362/396

(58) Field of Classification Search ..... 362/103–108, 362/200, 396, 570, 571, 640, 652, 655–659
See application file for complete search history.

(56) References Cited

U.S. PATENT DOCUMENTS

| | | | | |
|---|---|---|---|---|
| 1,109,415 | A | | 9/1914 | Harris |
| 1,914,429 | A | | 6/1933 | Houlihan et al |
| 2,234,995 | A | | 3/1941 | Waechter |
| D127,785 | S | | 4/1941 | Brodton |
| 2,539,104 | A | | 1/1951 | Rodel |
| D176,073 | S | | 11/1955 | Mantell |
| 3,032,647 | A | | 5/1962 | Wansky et al |
| D214,943 | S | | 8/1969 | Zapolski |
| D238,958 | S | | 2/1976 | Feinbloom |
| D266,192 | S | | 9/1982 | Feinbloom et al. |
| D274,758 | S | | 7/1984 | Shing |
| D275,523 | S | | 9/1984 | Ader |
| D296,719 | S | | 7/1988 | Lester |
| 4,794,496 | A | | 12/1988 | Lanes et al. |
| D300,868 | S | | 4/1989 | Conforti |
| 4,823,240 | A | * | 4/1989 | Shenker ..... 362/103 |
| 4,827,384 | A | | 5/1989 | Von Schlemmer |
| 4,916,596 | A | | 4/1990 | Sharrah et al. |
| 4,945,458 | A | | 7/1990 | Batts et al. |
| D318,338 | S | | 7/1991 | Mitchell |
| D320,667 | S | | 10/1991 | Smith |
| 5,117,510 | A | | 6/1992 | Broussard et al. |
| 5,154,483 | A | | 10/1992 | Zeller |
| D337,838 | S | | 7/1993 | Van Der Bel |
| 5,363,291 | A | * | 11/1994 | Steiner ..... 362/191 |
| D362,080 | S | | 9/1995 | Lehrer et al. |
| 5,463,538 | A | | 10/1995 | Womack |
| 5,541,816 | A | | 7/1996 | Miserendino |
| D373,433 | S | | 9/1996 | Feinbloom |
| D383,229 | S | | 9/1997 | Kiichiro |
| 5,680,718 | A | | 10/1997 | Ratcliffe et al. |
| 5,709,462 | A | * | 1/1998 | Rumpel ..... 362/237 |
| 5,738,431 | A | | 4/1998 | Lary |
| 5,741,060 | A | | 4/1998 | Johnson |
| 5,743,621 | A | | 4/1998 | Mantha et al. |
| D399,580 | S | | 10/1998 | Feinbloom |
| D405,202 | S | | 2/1999 | Fattori et al. |
| 5,894,604 | A | | 4/1999 | Crabb et al. |

(Continued)

*Primary Examiner*—Bao Q Truong
(74) *Attorney, Agent, or Firm*—Hoffberg & Associates

(57) ABSTRACT

A light adapted to be attached to an article of clothing, comprising a power supply casing, an illuminator casing, having therein an illuminator adapted to emit a beam of light when electrically powered, said power supply casing and illuminator casing being attachable and detachable to the article of clothing through an aperture by means of at least one extension, said at least one extension providing mechanical interconnection and a clamping force between said internal casing and a clamp to retain the article of clothing therebetween.

17 Claims, 6 Drawing Sheets

U.S. PATENT DOCUMENTS

| | | | | |
|---|---|---|---|---|
| D426,330 | S | 6/2000 | Cramer | |
| 6,183,116 | B1 | 2/2001 | Harter et al. | |
| D447,586 | S | 9/2001 | Shing | |
| 6,467,929 | B2 * | 10/2002 | Lee | 362/191 |
| 6,474,830 | B1 * | 11/2002 | Hansen | 362/103 |
| 6,634,031 | B1 | 10/2003 | Schlapkohl | |
| 6,733,150 | B1 | 5/2004 | Hanley | |
| D491,713 | S | 6/2004 | Wilson | |
| 6,752,511 | B1 | 6/2004 | Cramer | |
| 6,895,602 | B2 | 5/2005 | Schlapkohl | |
| D506,560 | S | 6/2005 | Oas | |
| 6,932,487 | B2 * | 8/2005 | Aknine | 362/106 |
| 7,086,749 | B1 | 8/2006 | Hanley | |

* cited by examiner

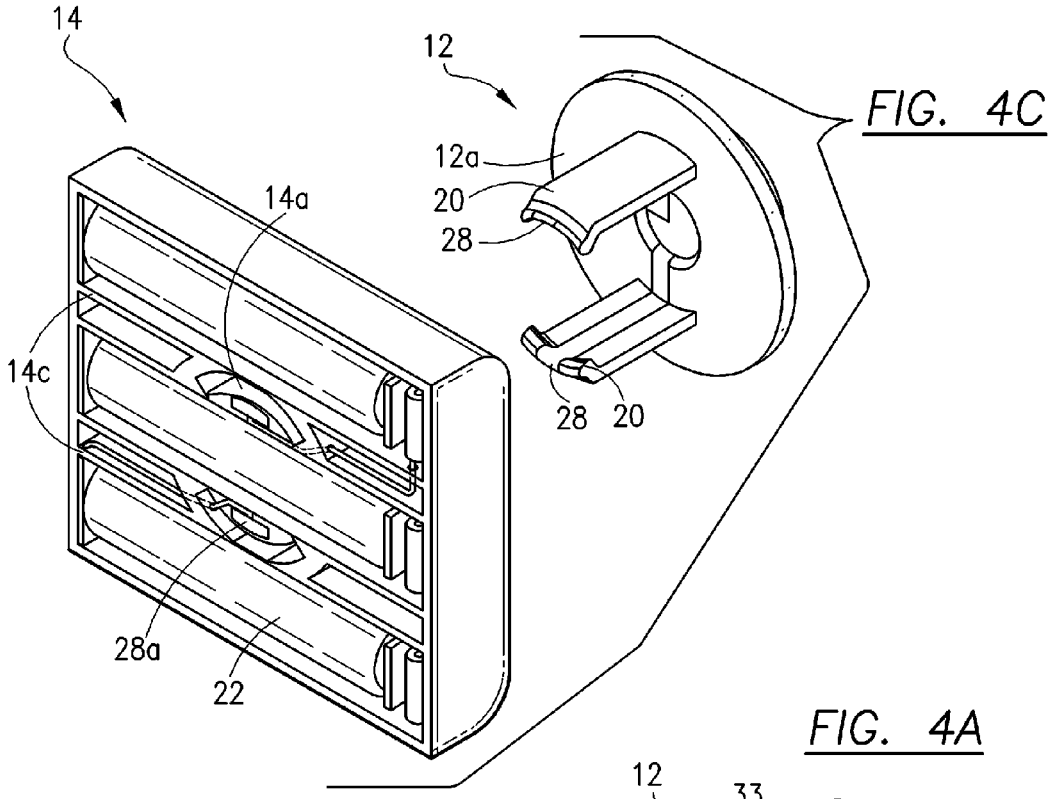
FIG. 4C
FIG. 4A
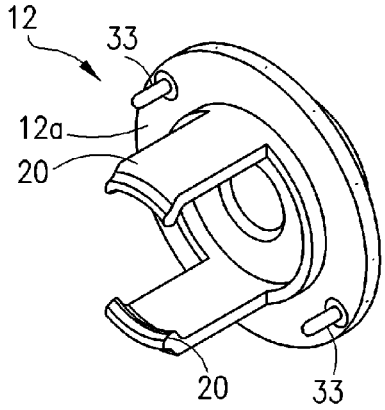
FIG. 4B
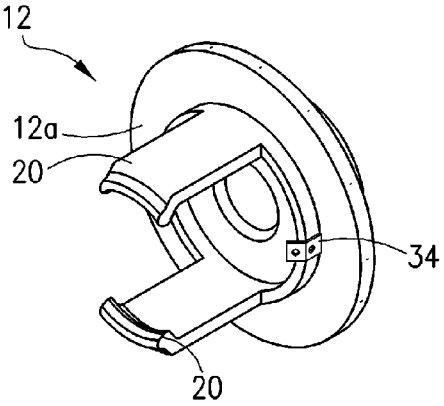

ILLUMINATION DEVICE MOUNTABLE THROUGH AN APERTURE IN A CLOTHING OBJECT

BACKGROUND OF THE INVENTION

1. Field of the Invention

This invention relates to an illumination device which is mountable through an aperture in a sheet of material, which, for example, is an object of clothing, such as a hat, shirt or jacket, for example an incandescent lamp, light emitting diode (LED) or an array of LEDs within a housing which may be mounted through a hole in an article of clothing, to provide lighting for a wearer.

2. Description of Related Art

Portable lights have been used in the past with garments, including lights attached to headgear or other garment articles for illumination purposes. Based on its usage such as in a hat (or on a garment), the size, weight, weight distribution and access to the battery pack become characteristics that affect the overall usability of the portable light. See, U.S. D426,330; D127,785; D176,073; D214,943; D238,958; D275,523; D296,719; D300,868; D318,338; D320,667; D337,838; D362,080; D373,433; U.S. Pat. No. 2,234,995, D506,560; D399,580; D266,192; U.S. Pat. No. 2,539,104; D383,229; D491,713; D405,202; D447,586; D274,758; U.S. Pat. Nos. 1,109,415; 1,914,429; 3,303,647; 3,032,647; 5,363,291; 5,541,816; 5,738,431; 5,741,060; 5,743,621; 6,183,116; 6,895,602; 6,467,929; 6,634,031; 5,680,718; 4,945,458; 4,916,596; 1,109,415; 4,827,384; 7,086,749; 6,733,150; 6,752,511; 6,932,487; 5,463,538; 5,154,483; 5,117,510; 4,794,496; 6,932,487; and 5,894,604, each of which is expressly incorporated herein by reference.

In headwear, any torque due to unbalanced masses may lead to sagging or slipping of the gear or object in which it is mounted out of alignment. Likewise, large batteries or other massive structures are undesirable. Protruding portions of the system, such as battery housings, lamp reflector housings, and the like, on the inside of a clothing object, may be uncomfortable. Adjustment opportunities for the beam axis on a clothing object has been limited in prior designs.

Various prior art light modules designed to clip or otherwise attach to clothing or headgear can become separated during use, or light modules attached to a head strap, may not stay in place or may be cumbersome and uncomfortable.

Another problem faced by the art is the switching mechanism, particularly in hat embodiments where the switch may be unseen by the user when sought to be actuated.

SUMMARY OF THE INVENTION

The present invention provides an illuminator, which preferably forms a light beam which may be aligned with the field of view of the wearer, which is attached through an aperture, to a sheet of fabric, which is typically an article of clothing, such as a hat, shirt or jacket.

The illuminator preferably has a power source, which is separated from the light emitter, for example connected through contacts, plugs or a cable.

The illuminator may be switched on and off, in certain embodiments, by manipulation of an illuminator subhousing with respect to a supporting structure, for example by means of a switch, rotation, or altering an inclination or axial angle of the subhousing.

In one embodiment, the design has a low profile, with the batteries placed unobtrusively in a compartment next to the body of a wearer, within an article of clothing, and the entire housing in this compartment is only slightly larger than the thickness the battery. Therefore, the illumination control is preferably not on a hidden portion of this compartment, since this may make actuation difficult. On the other hand, the illumination emitter is generally visible and available, making a control associated with this component attractive. In some instances, in spite of the generally forward field of illumination of the illuminator, it is desired to adjust the direction and/or breadth of the field of illumination, and thus some embodiments provide an adjustable axis of illumination and/or field of illumination.

The illumination source may be, for example, an incandescent bulb, e.g., a 3-4.5V halogen lamp, an LED or LED cluster, e.g., a set of white LED's to provide appropriate illumination, an electrical discharge and/or fluorescent bulb, a fiber optic illuminator, or other source.

The power source is preferably a pair of 1.5 V AA or AAA batteries, but LED illuminators and LED clusters particularly lend themselves to 3 V lithium coin cells, e.g., type CR2032, CR2430 or CR2450 batteries. This permits direct drive of the LED or LED cluster from the unregulated output of the batteries, simplifying the circuit. Of course, a regulated voltage design could also be employed. Preferably, a voltage-converter or other driver circuit is employed to drive a set of LEDs. This decouples, in part, the drive voltage of the LEDs from that directly available from the power source. Preferably, the drive circuit is integral with the circuit for mounting the LEDs, providing a two wire interface from the power supply to the LED support and driver circuit. Likewise, it is preferred that the subhousing holding the LED support and driver circuit be switched based on an intermittent supply of current through one or both of the supply wires, effecting a switch mechanism.

In preferred instances, the aperture in the article of clothing is specifically adapted to hold the illumination device, for example a circular hole, a keyed generally circular hole, or a reinforced slit (e.g., similar to a buttonhole) which may have reinforced edges. In other embodiments, an illuminator subhousing is located external to the article, while the power supply subhousing is located internal or external to the article. In the case where the components are separated, the two components may be connected by one or more extensions, which provide electrical connection and mechanical support. In the case where both are collocated, the perforation provides mechanical support only. The aperture may be, for example, a button hole, adapted to pass a connecting member therethrough. The illumination device may therefore be clamped to the material surrounding the aperture, to hold the illumination device securely in place.

According to a first embodiment, the illuminator subhousing is provided external to the article of the clothing, with the power supply subhousing provided within (internal to) the article of clothing. In this case, the depth of the power supply subhousing may be only slightly thicker than the thickness of a battery, for example about 0.563 inch, which is reduced from the prior art design according to U.S. Pat. No. 6,932,487, and D426,330, which has increased thickness due to the depth of the illuminator subhousing, e.g., about 0.875 inch. The illuminator subhousing, in this case, has a set of supports that penetrate through the article of clothing, which may be slits reinforced with thread, for example in the manner of buttonholes. The standoffs preferably provide mechanical support for the illuminator subhousing, as well as electrical connection, although the electrical connection may be provided by other means such as a plug type configuration or wire harness. The standoffs are separable from the power supply subhousing, thus permitting removal of the illumination unit from the article of clothing, for example to facilitate cleaning. With this configuration, the external illuminator subhousing may comprise various designs and light colors, and technologies, and indeed, the illuminator may be replaceable separate from the power supply and article of clothing. Since, in contrast to the design of U.S. Pat. No. 6,932,487, and D426,330, the illuminator subhousing does not protrude into the power supply subhousing. This provides for a more efficient design which allows at least one additional battery to be provided if so desired, and/or the power supply subhousing reduced in size. Likewise, eliminating some of the portion of the housing on the inside of the clothing minimizes wearer discomfort. This design can also be used with various sizes of batteries by adjusting the proportions of the power supply subhousing accordingly, the object being to maintain an efficient design in relation to the size and placement of the batteries. In known designs, a clip provided to retain the housing to the clothing, with the clip compressing a textile sheet against the housing. A pair of extensions protrude from the clip body and engage the housing, each extension having a width of about 0.625 inch for a 1.375 inch diameter hole, resulting in a noticeable arch. A preferred embodiment reduces the width of the extensions for connecting the housing to the clothing to about 0.375 inch, which reduces the arch depth, and enables the batteries to be placed closer together, further minimizing the space required by the sub-housing. If desired, the distance between extensions can be reduced, further increasing the efficiency of space in the power supply subhousing. Because the illuminator subhousing does not protrude into the power supply subhousing, a hole is no longer necessary and the extensions can be passed through be slits as indicated above.

According to one implementation of the invention, an optional power socket is provided to power an auxiliary device, such as an MP3 player or cell phone. Further, the clothing may be provided with an optional pocket for holding the auxiliary device. For example, a hat is provided with an illumination device in the front thereof. Internally or externally, a socket is provided which taps the power from the power supply, e.g., 3VDC, which passes through a cable to the auxiliary device. The power supply may include rechargeable batteries, in which case the same or a different connector may be used for recharging. Likewise, the power supply may be used to charge rechargeable batteries in the auxiliary device. The auxiliary device may be maintained within a pocket or recess, or beneath a band, in the hat.

According to another implementation of the invention, a camera and/or a microphone may be mounted in addition to, or in place of the illuminator, or these may be concealed within the illuminator casing. This camera and/or microphone units may be wireless for sending and remotely saving video and audio taken by the wearer, or may be saved within a memory module located within the illuminator casing, power supply casing or disposed in a location on the article of clothing or hat. The illuminator is preferably aligned with the lens axis, so that the illuminator effectively illuminates the scene. In some cases, the illumination may be infrared, and the camera responsive to infrared.

One embodiment provides a portable light that can be easily attached to a textile or fabric (found in a hat or other garment) that includes a housing for storing batteries (either rechargeable or disposable) and a separable lighting unit that includes an illumination source, for example a light bulb, a light on/off switch, the reflector, a reflector cover and a fabric clamping unit having at least one prong that clamps into the battery housing for securing said battery housing and light to said textile or fabric. The housing may also contain a connection for receiving power from and/or providing power to an external device.

A portable light unit is provided that can be readily secured to a textile or fabric such as a hat comprising a an illuminator sub-housing separably connected to a power supply casing which may contain at least one battery or be connected to a power supply such as battery case. In a preferred embodiment, the power supply casing is a flat, thin somewhat rectangular container for receiving one or more batteries, said battery case including electrodes for positive and negative contacts with each of the batteries stored in the battery case, said electrical contacts being connected to a plurality of wires terminating in series to a pair of electrodes mounted near the center of said battery case. The power supply casing may include a pair of female electrical receptacle slots in the outside wall that engage with the electrode mounting structure of the lighting unit and also function as electrodes to the battery case.

The lighting unit includes a transparent cover plate and a body, which in some embodiments serves as a reflector that has, for example, one or more light bulbs or LEDs mounted therein for illumination and a pair of conductors coming from the base of the lighting unit.

The lighting unit mounting plate has one or more rigid coupling connectors protruding approximately perpendicular out one side. The coupling connections may be partially plated or provided with a set of separate conductors to provide positive and negative electrodes. Which directly, or through other structures, provide power to the illuminator.

The illumination subhousing may have mounting prongs which are curved at their end tips, so that they can be secured resiliently inside engaging slots in the power supply subhousing so that they provide a strong retaining force, yet may be selectively disengaged and reengaged without breakage. In normal operation, the lighting unit is secure at all times, regardless of the normal forces on the clothing article. The power supply may be accessible from the inside of the article of clothing for changing batteries when necessary.

It is therefore an object to provide a light unit adapted to be attached to an article of clothing, comprising a power supply casing adapted to hold at least one of a battery and a connector adapted to interface with an external battery, providing electrical connections thereto; an illuminator casing, having therein an illuminator adapted to emit a beam of light when electrically powered; an electrical switch, adapted to selectively interrupt power from the power supply casing to the illuminator; the power supply casing and the illuminator casing being attachable and detachable by means of at least one extension, the at least one extension providing mechanical interconnection and a clamping force between the power supply casing and the illuminator casing to retain the article of clothing therebetween, an electrical connector mechanism, automatically providing an electric circuit between the power supply casing and the illuminator casing when the at least one extension attaches the power supply casing and the illuminator.

The at least one extension may comprise a pair of members having snaps which mate to corresponding recesses, wherein the snaps are inserted in the recesses to provide a mechanical connection. The electrical connector mechanism may be integral with the at least one extension. The at least one extension may comprise at least two extensions, and the electrical connector mechanism is integral with the at least two extensions, wherein a portion of a current path is provided by each of a pair of the extensions. The article of clothing may comprise a hat having a recess adapted to hold an auxiliary device, and wherein the power supply casing comprises an electrical connector adapted to mate with the auxiliary device. The auxiliary device may draw power from the power supply casing. The auxiliary device may supply power to the power supply casing. The at least one extension may be attachable and detachable by mutual rotation. The battery has a defined thickness, and a thickness of the power supply casing being approximately no greater than the sum of thickness of the battery, a wall thickness of the power supply casing, and a thickness of a mechanical interconnection portion of the power supply casing. The power supply casing may comprise a connector adapted to interface with an external battery, further comprising an external battery housing and a power cable interconnecting the external battery housing and the power supply casing.

It is a further object to provide a method of providing illumination from an article of clothing, comprising providing a power supply casing adapted to hold at least one of a battery and a connector adapted to interface with an external battery, providing electrical connections thereto, an illuminator casing, having therein an illuminator adapted to emit a beam of light when electrically powered, and an electrical switch, adapted to selectively interrupt power from the power supply casing to the illuminator; attaching the power supply casing to the illuminator casing by mechanically engaging at least one extension, to provide a clamping force between the power supply casing and the illuminator casing to retain the article of clothing therebetween, and automatically providing an electric circuit between the power supply casing and the illuminator casing; and detaching the power supply casing to the illuminator casing by mechanically disengaging the at least one extension.

It is a still further object to provide a light adapted to be attached to an article of clothing, comprising a power supply casing adapted to hold at least one of a battery and a connector adapted to interface with an external battery, providing electrical connections thereto, the battery having a thickness, a thickness of the power supply casing being no greater than approximately sum of the thickness of the battery, a wall thickness of the power supply casing, and a thickness of a mechanical interconnection portion of the power supply casing; an illuminator casing, having therein an illuminator adapted to emit a beam of light when electrically powered, attached to the power supply casing through a coupling which permits the illuminator casing to be moved about at least one axis; an electrical switch, adapted to selectively interrupt power from the power supply casing to the illuminator; a clamp, having at least one extension providing mechanical interconnection and a clamping force with respect to the power supply casing, to retain the article of clothing therebetween, at least a portion of the illuminator casing extending forward of the power supply casing with respect to the article of clothing.

The coupling may provide a horizontal pivot about which the illuminator housing moves. The coupling may also comprise a ball in socket mechanism providing freedom of movement about both horizontal and vertical axes for the illuminator housing. The power supply casing may be adapted to be disposed on an inside portion of the article of clothing, with the illuminator casing providing illumination outside of the article of clothing. The power supply casing may be adapted to be disposed on an outside portion of the article of clothing, the clamp adapted to be positioned inside the article of clothing, with the illuminator casing providing illumination outside of the article of clothing. The power supply casing may comprise a connector adapted to interface with an external battery, further comprising an external battery housing and a power cable interconnecting the external battery housing and the power supply casing.

It is a still further object to provide a light adapted to be attached to an article of clothing, comprising: a power supply casing adapted to hold and electrically connect at least one of a battery and a connector adapted to interface with an external battery, the battery having a thickness, a thickness of the power supply casing if holding a battery being no greater than approximately sum of the thickness of the battery, a wall thickness of the power supply casing, and a thickness of a mechanical interconnection portion of the power supply casing; an illuminator, disposed within the power supply casing, adapted to emit light when electrically powered, attached to the at least one battery; an electrical switch, adapted to selectively interrupt power from the power supply casing to the illuminator; a clamp, having at least one extension providing mechanical interconnection and a clamping force with respect to the power supply casing, to retain the article of clothing therebetween; and a flexible, repositionable optic conduit for guiding light from the illuminator to a port external to the article of clothing.

It is another object to provide a light adapted to be attached to an article of clothing, comprising: an internal casing having a maximum thickness of less than about 0.65 inches; an illuminator casing, having therein an illuminator adapted to emit a beam of light when electrically powered; an electrical switch, adapted to selectively interrupt power to the illuminator; the internal casing being attachable and detachable to the article of clothing through an aperture by means of at least one extension, the at least one extension providing mechanical interconnection and a clamping force between the internal casing and a clamp to retain the article of clothing therebetween.

In accordance with these and other objects which will become apparent hereinafter, the instant invention will now be described with particular reference to the accompanying drawings.

BRIEF DESCRIPTION OF THE DRAWINGS

FIGS. 4A, 4B and 4C show an exploded view of the illuminator casing and the power supply casing separated from a rear perspective view according to the embodiment of FIG. 1C and respective electrical connection options.

PREFERRED EMBODIMENTS OF THE INVENTION

Figure 1C:
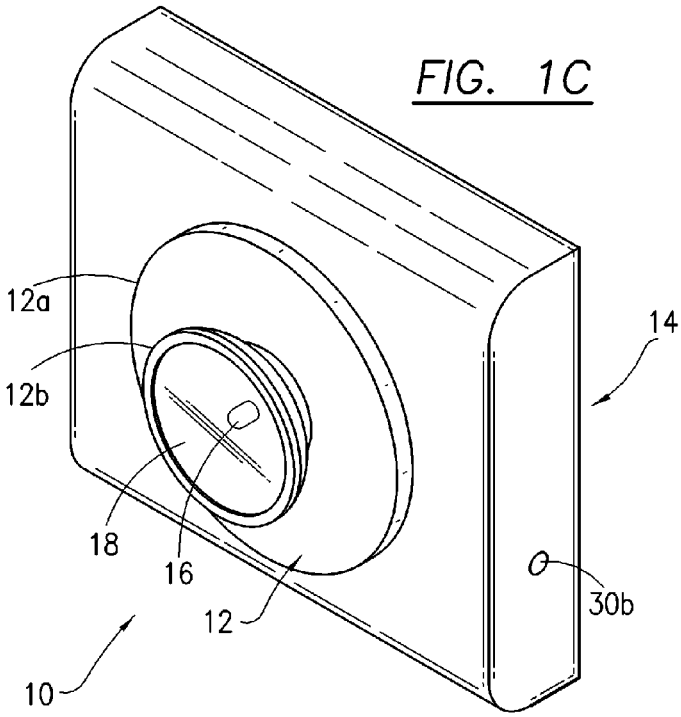
FIGS. 1A, 1B and 1C show a front perspective view of a first embodiment of the present invention and respective power port options.

Referring now to the drawings, FIGS. 1A through 9 depict a preferred embodiment and variants thereof, wherein the illuminator casing and the power supply casing are separate from each other. The illuminator casing is located on the outside of the article of clothing or hat, and the power supply casing is located on the inside of the article of clothing. This preferred set of embodiments allows use of a power supply casing that has an efficient design and low profile, thereby providing comfort for the wearer. The illuminator casing and power supply casing are attached together through one or more apertures in the article of clothing or hat. It is also possible to provide an embodiment wherein the a thin wire extends from the power supply casing inside the article, and the illuminator casing external, without forming an aperture. A strong magnet may then be used to sandwich the article of clothing and support the illuminator casing in position, against another magnet or a steel plate. A clamped piercing pin may also be used to attach the casings. If two pins are used, ten each can carry current, and the wires eliminated. Thus, a preformed aperture in the article of clothing, while preferred, is not required in all cases.

Figure 1A:
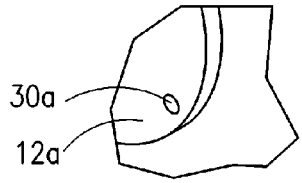
Figure 1B:
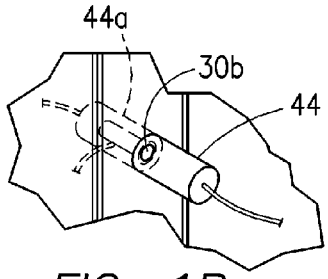

In particular, FIGS. 1A-1C, the lighting unit 10 includes a power supply casing 14 and a illuminator casing 12 that are shown in FIG. 1C connected together. What is not shown in FIG. 1 is that a fabric or textile would be clamped in between the connecting plate 12*a* and the power supply casing 14.

An incandescent bulb 16 is mounted inside a reflector 18 that is parabolic shaped and may be formed as part of the illuminator casing housing 12*b* which may be molded together with the connecting plate 12*a*, or provided as a separable element therefrom. In alternate embodiments, the incandescent bulb 16 can be replaced with a single LED or an array of LED's, and that different types illuminators, reflectors, lenses and other optics can be employed.

Also shown in FIGS. 1C and 1B is an optional jack aperture 30*b* that has a female jack 44*a* for receiving DC power from the power supply casing 14 that if included allows a user to plug in the male jack and power supply cable 44 into the power supply casing 14 in order to provide power to or charge an auxiliary device such as a music player, cellular phone, personal digital assistant or other auxiliary electronic device to receive. An alternate or additional location for the optional jack aperture 30*a* is provided on the front of the connecting plate 12*a*.

Figure 3:
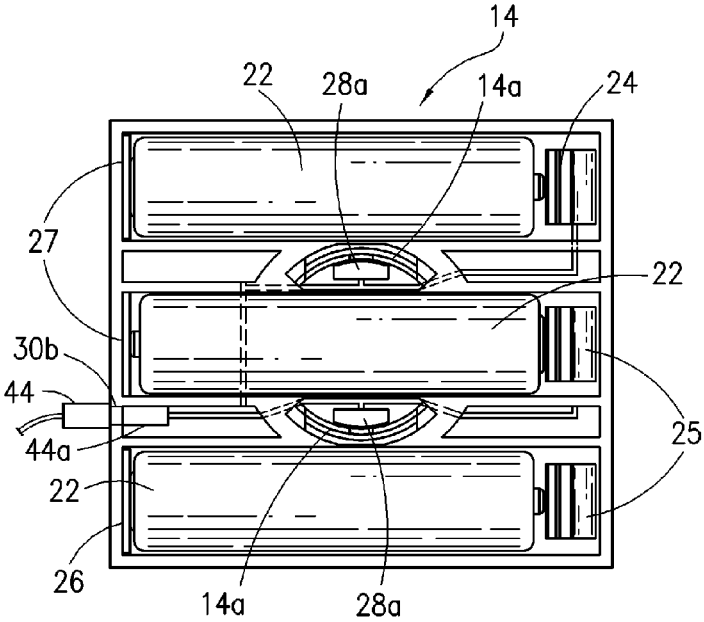
FIG. 3 shows a back elevational view of the back of the power supply casing of the embodiment according to FIG. 1C.
Figure 2:
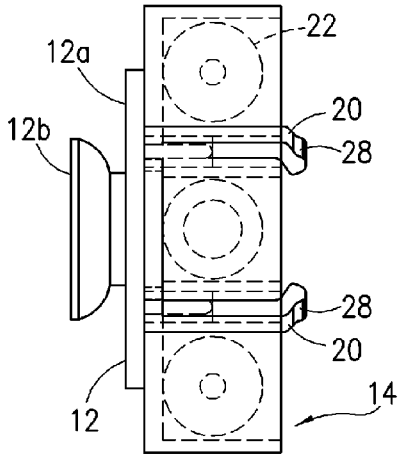
FIG. 2 shows a side elevational view of the embodiment according to FIG. 1C.

Referring now to FIGS. 2 and 3, the attachment between the illuminator casing 12 and the power supply casing 14 is achieved by one or more prongs 20 that are molded or attached permanently to the connecting plate 12*a*, and are also electrically connected by contacts 28 to form a circuit with the bulb 16 within the illuminator casing housing 12*b*. In this preferred embodiment, the power supply casing 14 holds three type AAA batteries 22 substantially in parallel compartments, that are connected together electrically in series between contacts 24 and 26 by interconnections 25, 27. Also shown in FIG. 3 are slots 14*a* in the power supply casing 14 that includes contacts 28*a* that engage the contacts 28 on the one or more prongs 20 shown in FIG. 2 when the illuminator casing 12 is attached to the power supply casing 14, to allow completing the electrical circuit. An on/off switch can be provided on the illuminator casing 12 itself, which could be actuated by twisting the illuminator casing housing 12*b* or by means of a conventional switch (not shown). Alternate embodiments can utilize more or less than three type AAA batteries, or other types of batteries, and the batteries can be located remotely from the power supply housing and connected by wires (not shown), thereby enabling the use of a smaller, more compact power supply casing. Also shown in FIG. 3 is the optional jack aperture 30*b*, the female jack 44*a* and the male jack and power supply cable 44.

Referring now to FIGS. 4A, 4B and 4C, the illuminator casing 12 is shown separated from the power supply casing 14. In the preferred embodiment, two prongs 20 are used for holding the illuminator casing 12 to the power supply casing 14. The prongs 20 snap into slots 14*a*, which engage by means of a contoured end of the prong 20. As shown in FIG. 4C, the power supply housing 14 includes three compartments for the batteries 22 which are separated by parallel walls 14*c* which are molded into the power supply casing 14. Also molded in place are the prong slots 14*a* for receiving the prongs 20. Each prong 20 is typically slightly longer than the thickness of the power supply casing 14, with a slight curved flange at its end which resiliently snaps into place to firmly hold the illuminator casing 12 in place against the power supply casing 14. Advantageously, a fabric, for example part of an article of clothing or hat, not shown, can be trapped between the illuminator casing 12 and the power supply casing 14 in order to provide support. Instead of using contacts 28 on the prongs 20, FIGS. 4A and 4B show alternate methods for making an electrical connection between the illuminator casing 12 and the power supply casing 14. Plugs 33 or contacts 34 (only one visible) can be located on the back of the connecting plate 12*a*, with corresponding connections on the power supply housing (not shown). Alternately, the plugs 33 or contacts 34 can be placed on the power supply casing 14 with corresponding connections on the illuminator casing housing 12. In the preferred embodiment, reinforced slot like apertures similar to button holes are included in the article of clothing or hat through which the prongs 20 are passed. In the alternate embodiments of FIGS. 4A and 4B, additional apertures need to be included for the electrical connectors, or in the case of FIG. 4B a single round aperture with a diameter corresponding to the distance between the prongs 20 can be utilized.

Figure 5:
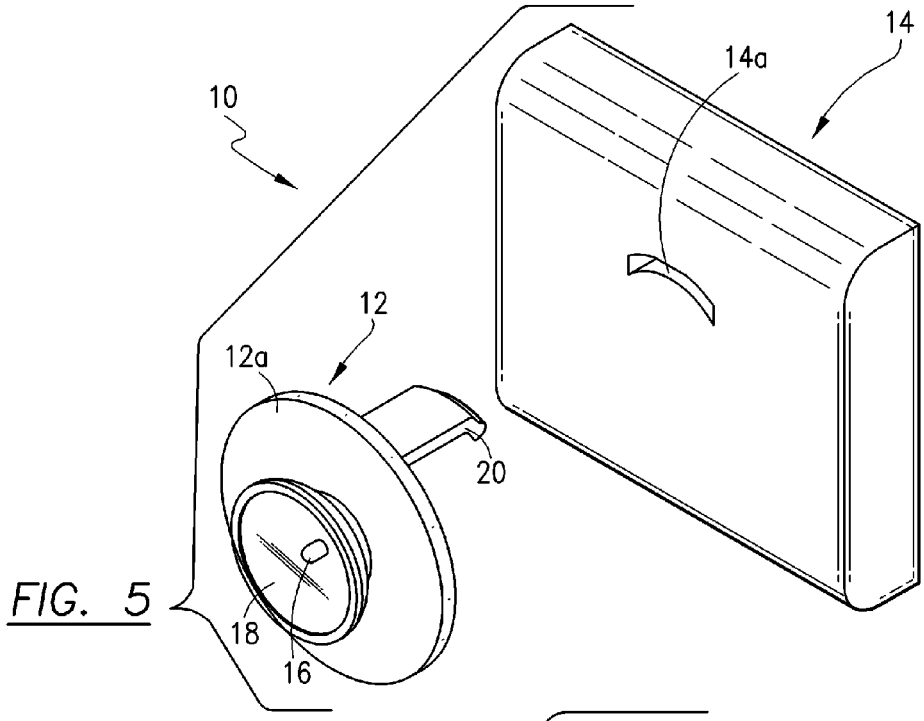
FIG. 5 shows a front perspective exploded view of the lighting unit of the embodiment according to FIG. 1C, with the power supply casing and the illuminator casing separated, and using only one extension for connecting the two components together.

FIG. 5 shows an alternate embodiment using a single prong 20 with two contacts (not visible), or alternatively using connectors as shown in FIGS. 4A and 4B. Alternately, more than two prongs can also be used.

Figure 6:
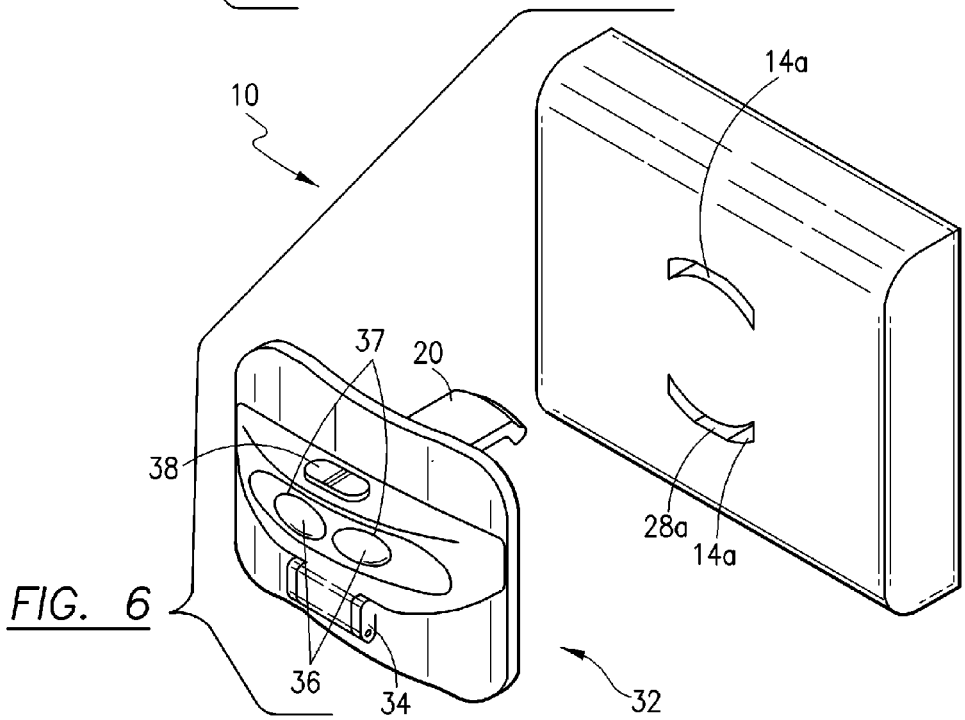
FIG. 6 shows an embodiment of the invention in a perspective front exploded view of the embodiment according to FIG. 1C with an alternate illuminator style. The power supply casing and the illuminator casing separated.
Figure 7:
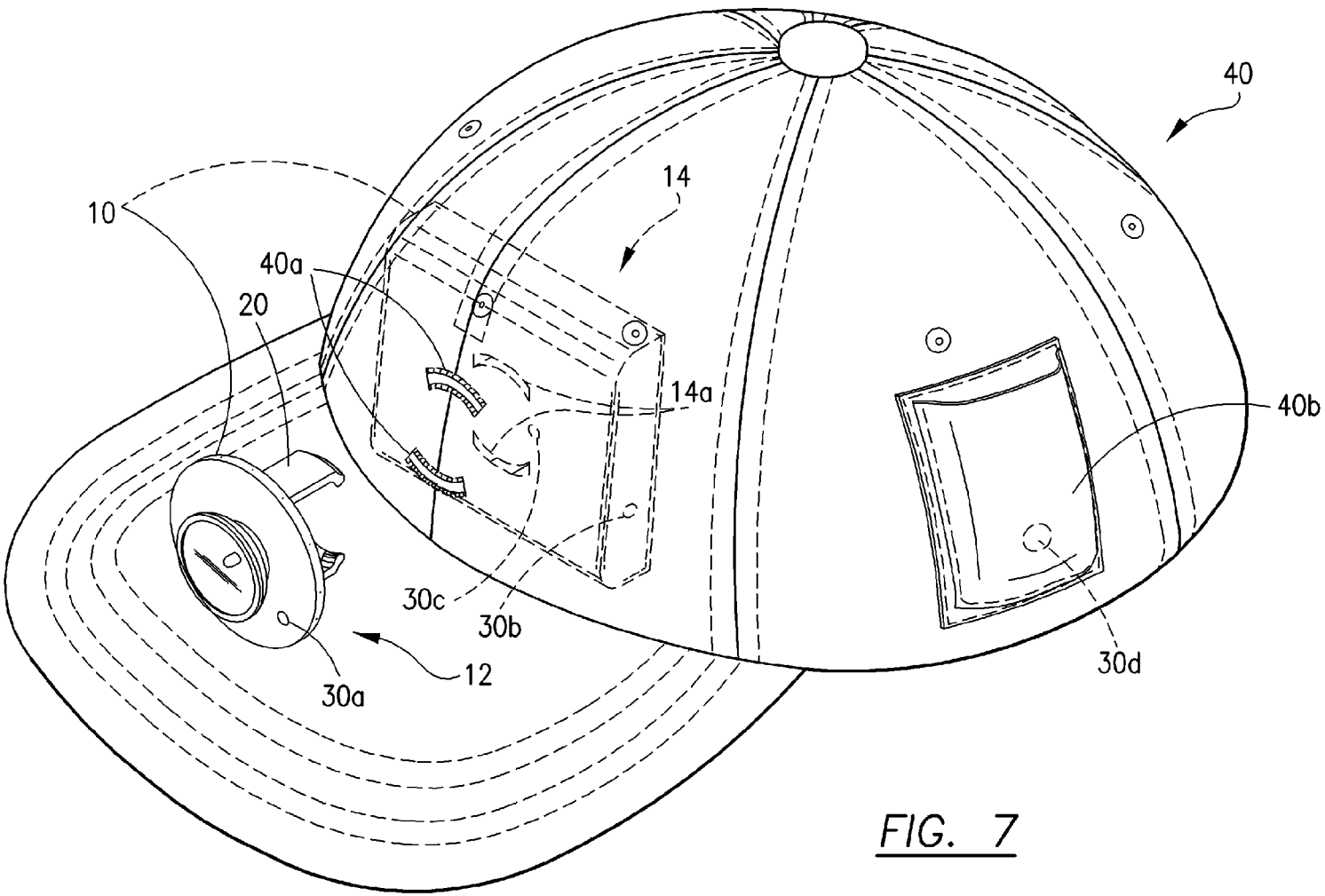
FIG. 7 shows a perspective view of a baseball cap with accessory pocket and the lighting unit exploded in front of the embodiment according to FIG. 1C.

Referring now to FIG. 6, an alternate embodiment of the invention is shown in which uses a different type of illuminator casings 32 which, in this case, includes LED illuminators 36, which may be white or other colors, and which may change color over time, or in different modes of operation, lenses 37 for focusing the light beam, a hinged flip out panel 34 for adjusting the angle of the light beam and an on/off switch 38. As with the embodiment of FIG. 1C, the illuminator casing 32 is snapped into the power supply casing 14 using one or more prongs 20 passing through slots 14*a* with electrical connections 28 (not visible) and 28*a* as discussed above. Referring now to FIG. 7, the illuminator casing 12 is shown in an exploded view with the power supply casing 14 mounted on the inside of a cap 40, which has an optional pocket 40*b*. A pad (not shown) is preferably provided behind the power supply casing to provide increased comfort for the wearer. The cap 40 has one or more slots like apertures 40*a* which correspond to the size and spacing of the prongs 20 of the illuminator casing 12, and which engage the slots 14*a* in the power supply casing 14 as described above. Thus, in this embodiment, once the illuminator casing 12 is snapped into the power supply casing 14, the light unit 10 is held securely in place on the cap 40. A cable with an electrical connector such as a male jack (not shown) may be used to power a device situated in the optional pocket 40*b*, either through the optional aperture 30*b* and female jack connector (not shown), which would terminate in the pocket 40*b*, or through apertures 30*a* on the illuminator casing and power supply casing and 30*c* on the cap 40, and the female jack (not shown) corresponding to the aperture 30*a*. If the cable terminates in the optional pocket 40*b*, it may be through aperture in the cap 30*d* on the inside of said optional pocket 40*b*.

Figure 8:
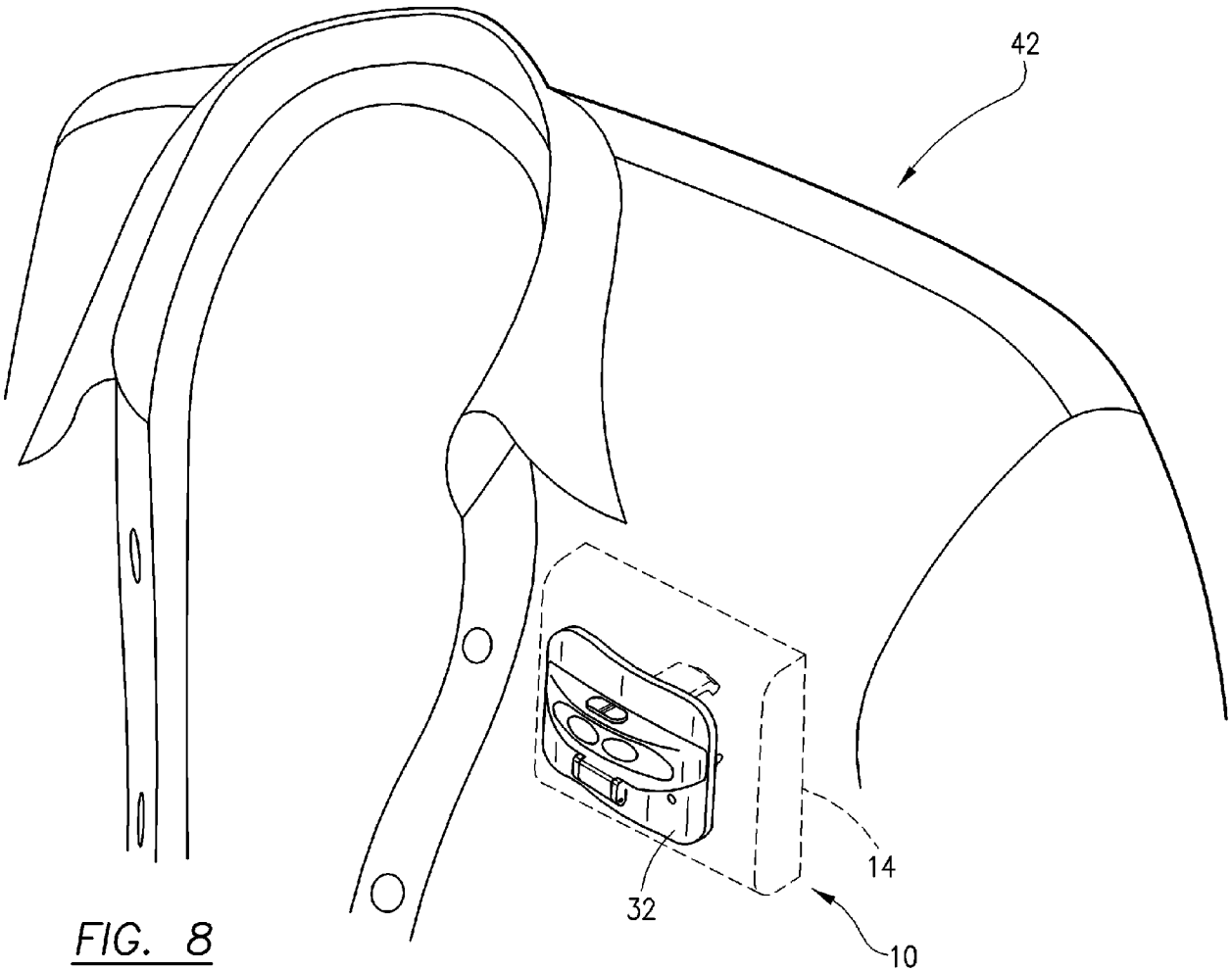
FIG. 8 shows a perspective view of the embodiment according to FIG. 6 with a shirt.

Referring now to FIG. 8, the embodiment of the invention is shown which was described with reference to FIG. 6 above, but used this time on a shirt or jacket 42 which would have a pair of slot like apertures resembling button holes that allows the lighting unit 10 to be attached to the shirt or jacket 42 by clamping the illuminator casing 32 outside the shirt or jacket 42 to the power supply casing 14 inside the shirt or jacket 42.

Figure 9:
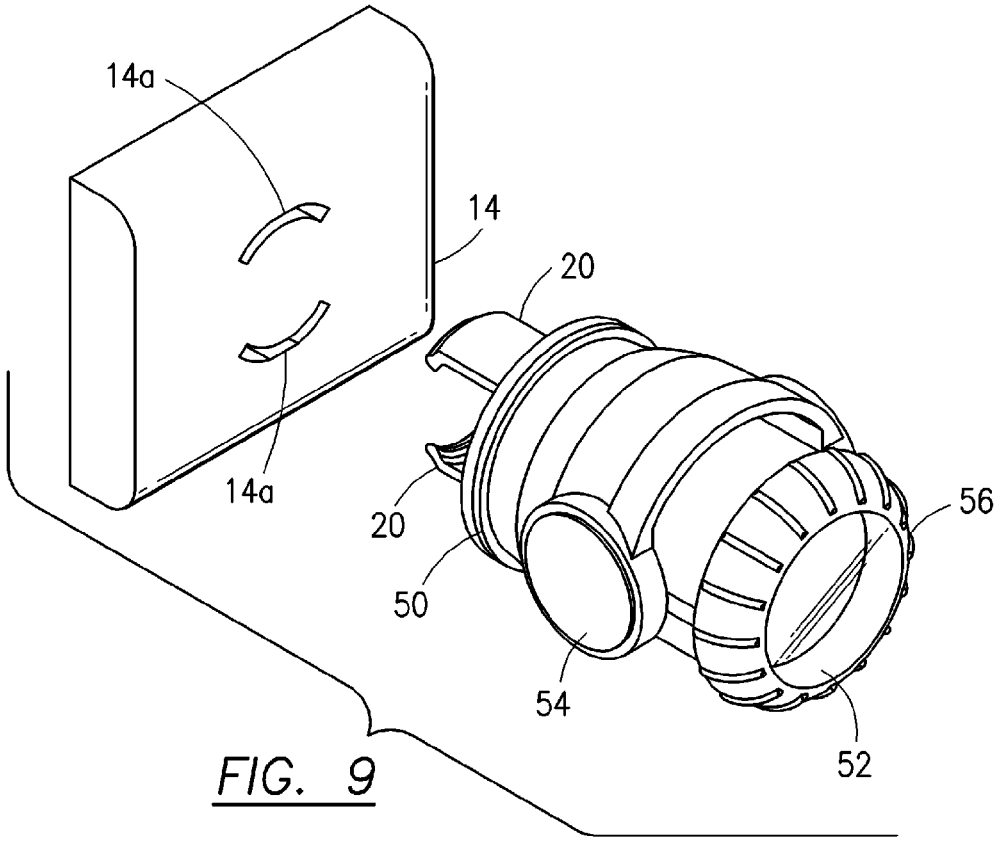
FIG. 9 shows a front perspective exploded view of another embodiment of the invention with an alternate illuminator style.

Referring now to FIG. 9, yet another alternate illuminator casing 50 is provided having prongs 20 which engage slots 14*a* of the power supply casing 14. In this case, the illuminator casing 50 has a lens 52, a hinge 54 which allows the direction of the light beam to be changed, and a rotatable ring 56 which can be used as a power switch and/or to focus the pattern of the light beam.

It should be noted that throughout the figures and descriptions, the power supply casings contain space for batteries; however, in variations the batteries can be located separately from the power supply casing, and connected with wires which may be permanently fixed or detachable using a wire harness plugs or other methods commonly used to connect wires.

The instant invention has been shown and described herein in what is considered to be the most practical and preferred embodiments. It is recognized, however, that departures may be made therefrom within the scope of the invention and that obvious modifications will occur to a person skilled in the art.

What I claim is:

1. A light adapted to be attached to an article of clothing, comprising:

a power supply casing adapted to hold at least one of a battery and a connector adapted to interface with an external battery, providing electrical connections thereto;

an illuminator casing, having therein an illuminator adapted to emit a beam of light when electrically powered;

an electrical switch, adapted to selectively interrupt power from said power supply casing to said illuminator;

said power supply casing and said illuminator casing being attachable and detachable, a clamping force between said power supply casing and said illuminator casing being generated to retain the article of clothing therebetween, an electrical connector mechanism, automatically providing an electric circuit between said power supply casing and said illuminator casing.

2. The light according to claim 1, wherein said power supply and said illuminator casing are attachable and detachable by means of at least one extension, said at least one extension providing a mechanical interconnection therebetween.

3. The light according to claim 2, wherein said at least one extension comprises a pair of members having snaps which mate to corresponding recesses, wherein said snaps are inserted in said recesses to provide a mechanical connection.

4. The light according to claim 1, wherein said electrical connector mechanism is integral with said at least one extension.

5. The light according to claim 2, wherein said at least one extension comprises at least two extensions, and said electrical connector mechanism is integral with said at least two extensions, wherein a portion of a current path is provided by each of a pair of said extensions.

6. The light according to claim 1, wherein at least one of the article of clothing comprises a hat having a recess adapted to hold an auxiliary device, and wherein said power supply casing comprises an electrical connector adapted to mate with the auxiliary device.

7. The light according to claim 6, wherein the auxiliary device draws power from said power supply casing.

8. The light according to claim 6, wherein the auxiliary device supplies power to said power supply casing.

9. The light according to claim 2, wherein said at least one extension is attachable and detachable by mutual rotation.

10. The light according to claim 1, wherein the battery has a thickness, a thickness of said power supply casing being approximately no greater than the sum of thickness of the battery, a wall thickness of the power supply casing, and a thickness of a mechanical interconnection portion of said power supply casing.

11. The light according to claim 1, wherein said power supply casing comprises a connector adapted to interface with an external battery, further comprising an external battery housing and a power cable interconnecting the external battery housing and the power supply casing.

12. The light according to claim 2, wherein said at least one extension is disposed on the illuminator casing.

13. The light according to claim 12 wherein said at least one extension is disposed on the power supply casing.

14. The light according to claim 1, wherein said power supply casing and said illuminator casing are attachable and detachable by means of a hook and loop fastener which maintains the mechanical interconnection and clamping force to retain the article of clothing therebetween.

15. The light according to claim 1, wherein at least one of said power supply casing and said illuminator casing is equipped with a magnet, to maintain the mechanical interconnection and clamping force to retain the article of clothing therebetween.

16. A method of providing illumination from an article of clothing, comprising:

providing a power supply casing adapted to hold at least one of a battery and a connector adapted to interface with an external battery, providing electrical connections thereto, an illuminator casing, having therein an illuminator adapted to emit a beam of light when electrically powered, and an electrical switch, adapted to selectively interrupt power from said power supply casing to the illuminator;

attaching the power supply casing to the illuminator casing, to provide a clamping force between the power supply casing and the illuminator casing through an article of clothing so as to retain the article of clothing therebetween, and automatically providing an electric circuit between the power supply casing and the illuminator casing; and detaching the power supply casing to the illuminator casing by mechanically disengaging the at least one extension.

17. The method according to claim 16, wherein the power supply casing and the illuminator casing are mechanically engaged with at least one extension.

* * * * *